US005595706A

United States Patent [19]

Sikka et al.

[11] Patent Number: 5,595,706

[45] Date of Patent: Jan. 21, 1997

[54] ALUMINUM CONTAINING IRON-BASE ALLOYS USEFUL AS ELECTRICAL RESISTANCE HEATING ELEMENTS

[75] Inventors: Vinod K. Sikka; Seetharama C. Deevi, both of Oak Ridge, Tenn.; Grier S. Fleischhauer, Midlothian, Va.; Mohammad R. Hajaligol, Richmond, Va.; A. Clifton Lilly, Jr., Chesterfield, Va.

[73] Assignee: Philip Morris Incorporated, New York, N.Y.

[21] Appl. No.: 365,952

[22] Filed: Dec. 29, 1994

[51] Int. Cl.[6] ..... C22C 38/06

[52] U.S. Cl. ..... 420/81

[58] Field of Search ..... 420/81

[56] References Cited

U.S. PATENT DOCUMENTS

| | | |
|---|---|---|
| 1,550,508 | 8/1925 | Cooper . |
| 1,990,650 | 2/1935 | Jasper . |
| 2,300,336 | 10/1942 | Bozorth et al. . |
| 2,768,915 | 10/1956 | Nachman et al. . |
| 3,026,197 | 3/1962 | Schramm . |
| 3,676,109 | 7/1972 | Cooper . |
| 4,391,634 | 7/1983 | Kelly et al. . |
| 4,961,903 | 10/1990 | McKamey et al. . |
| 5,032,190 | 7/1991 | Suarez et al. . |
| 5,084,109 | 1/1992 | Sikka . |
| 5,158,744 | 10/1992 | Nazmy . |
| 5,173,254 | 12/1992 | Amano et al. . |
| 5,238,645 | 8/1993 | Sikka et al. . |
| 5,320,802 | 6/1994 | Liu et al. . |
| 5,439,640 | 8/1995 | Heck et al. ..... 420/585 |

FOREIGN PATENT DOCUMENTS

| | | |
|---|---|---|
| 0495121A1 | 7/1992 | European Pat. Off. . |
| 0495123A1 | 7/1992 | European Pat. Off. . |

*Primary Examiner*—Deborah Yee

*Attorney, Agent, or Firm*—Burns, Doane, Swecker & Mathis LLP

[57] ABSTRACT

The invention relates generally to aluminum containing iron-base alloys useful as electrical resistance heating elements. The aluminum containing iron-base alloys have a disordered body centered cubic structure and improved room temperature ductility, electrical resistivity, cyclic fatigue resistance, high temperature oxidation resistance, low and high temperature strength, and/or resistance to high temperature sagging. The alloy has an entirely ferritic microstructure which is free of austenite and includes, in weight %, 4 to 9.5% Al, 0.2–2.0% Ti, 0.5–2% Mo, 0.1 to 0.8% Zr, 0.01–0.5% C, balance Fe.

28 Claims, 9 Drawing Sheets

ALUMINUM CONTAINING IRON-BASE ALLOYS USEFUL AS ELECTRICAL RESISTANCE HEATING ELEMENTS

FIELD OF THE INVENTION

The invention relates generally to aluminum containing iron-base alloys useful as electrical resistance heating elements.

BACKGROUND OF THE INVENTION

Iron base alloys containing aluminum can have ordered and disordered body centered crystal structures. For instance, iron aluminide alloys having intermetallic alloy compositions contain iron and aluminum in various atomic proportions such as $Fe_3Al$, FeAl, $FeAl_2$, $FeAl_3$, and $Fe_2Al_5$. $Fe_3Al$ intermetallic iron aluminides having a body centered cubic ordered crystal structure are disclosed in U.S. Pat. Nos. 5,320,802; 5,158,744; 5,024,109; and 4,961,903. Such ordered crystal structures generally contain 25 to 40 atomic % Al and alloying additions such as Zr, B, Mo, C, Cr, V, Nb, Si and Y.

An iron aluminide alloy having a disordered body centered crystal structure is disclosed in U.S. Pat. No. 5,238,645 wherein the alloy includes, in weight %, 8–9.5 Al, ≦7 Cr, ≦4 Mo, ≦0.05 C, ≦0.5 Zr and ≦0.1 Y, preferably 4.5–5.5 Cr. 1.8–2.2 Mo, 0.02–0.032 C and 0.15–0.25 Zr. Except for three binary alloys having 8.46, 12.04 and 15.90 wt % Al, respectively, all of the specific alloy compositions disclosed in the '645 patent include a minimum of 5 wt % Cr. Further, the '645 patent states that the alloying elements improve strength, room-temperature ductility, high temperature oxidation resistance, aqueous corrosion resistance and resistance to pitting. The '645 patent does not relate to electrical resistance heating elements and does not address properties such as thermal fatigue resistance, electrical resistivity or high temperature sag resistance.

Iron-base alloys containing 3–18 wt % Al, 0.05–0.5 wt % Zr, 0.01–0.1 wt % B and optional Cr, Ti and Mo are disclosed in U.S. Pat. No. 3,026,197 and Canadian Patent No. 648,140. The Zr and B are stated to provide grain refinement, the preferred Al content is 10–18 wt % and the alloys are disclosed as having oxidation resistance, and workability. However, like the '645 patent, the '197 and Canadian patents do not relate to electrical resistance heating elements and does not address properties such as thermal fatigue resistance, electrical resistivity or high temperature sag resistance.

U.S. Pat. No. 3,676,109 discloses an iron-base alloy containing 3–10 wt % Al, 4–8 wt % Cr, about 0.5 wt % Cu, less than 0.05 wt % C, 0.5–2 wt % Ti and optional Mn and B. The '109 patent discloses that the Cu improves resistance to rust spotting, the Cr avoids embrittlement and the Ti provides precipitation hardening. The '109 patent states that the alloys are useful for chemical processing equipment. All of the specific examples disclosed in the '109 patent include 0.5 wt % Cu and at least 1 wt % Cr, with the preferred alloys having at least 9 wt % total Al and Cr, a minimum Cr or Al of at least 6 wt % and a difference between the Al and Cr contents of less than 6 wt %. However, like the '645 patent, the '109 patent does not relate to electrical resistance heating elements and does not address properties such as thermal fatigue resistance, electrical resistivity or high temperature sag resistance.

Iron-base aluminum containing alloys for use as electrical resistance heating elements are disclosed in U.S. Pat. Nos. 1,550,508; 1,990,650; and 2,768,915 and in Canadian Patent No. 648,141. The alloys disclosed in the '508 patent include 20 wt % Al, 10 wt % Mn; 12–15 wt % Al, 6–8 wt % Mn; or 12–16 wt % Al, 2–10 wt % Cr. All of the specific examples disclosed in the '508 patent include at least 6 wt % Cr and at least 10 wt % Al. The alloys disclosed in the '650 patent include 16–20 wt % Al, 5–10 wt % Cr, ≦0.05 wt % C, ≦0.25 wt % Si, 0.1–0.5 wt % Ti, ≦1.5 wt % Mo and 0.4–1.5 wt % Mn and the only specific example includes 17.5 wt % Al, 8.5 wt % Cr, 0.44 wt % Mn, 0.36 wt % Ti, 0.02 wt % C and 0.13 wt % Si. The alloys disclosed in the '915 patent include 10–18 wt % Al, 1–5 wt % Mo, Ti, Ta, V, Cb, Cr, Ni, B and W and the only specific example includes 16 wt % Al and 3 wt % Mo. The alloys disclosed in the Canadian patent include 6–11 wt % Al, 3–10 wt % Cr, ≦4 wt % Mn, ≦1 wt % Si, ≦0.4 wt % Ti, ≦0.5 wt % C, 0.2–0.5 wt % Zr and 0.05–0.1 wt % B and the only specific examples include at least 5 wt % Cr.

Resistance heaters of various materials are disclosed in U.S. Pat. No. 5,249,586 and in U.S. patent application Ser. Nos. 07/943,504, 08/118,665, 08/105,346 and 08/224,848.

U.S. Pat. No. 4,334,923 discloses a cold-rollable oxidation resistant iron-base alloy useful for catalytic converters containing ≦0.05% C, 0.1–2% Si, 2–8% Al, 0.02–1% Y, <0.009% P, <0.006% S and <0.009% 0.

U.S. Pat. No. 4,684,505 discloses a heat resistant iron-base alloy containing 10–22% Al, 2–12% Ti, 2–12% Mo, 0.1–1.2% Hf, ≦1.5% Si, ≦0.3% C, ≦0.2% B, ≦1.0% Ta, ≦0.5% W, ≦0.5% V, ≦0.5% Mn, ≦0.3% Co, ≦0.3% Nb, and ≦0.2% La. The '505 patent discloses a specific alloy having 16% Al, 0.5% Hf, 4% Mo, 3% Si, 4% Ti and 0.2% C.

Japanese Laid-open Patent Application No. 53-119721 discloses a wear resistant, high magnetic permeability alloy having good workability and containing 1.5–17% Al, 0.2–15% Cr and 0.01–8% total of optional additions of <4% Si, <8% Mo, <8% W, <8% Ti, <8% Ge, <8% Cu, <8% V, <8% Mn, <8% Nb, <8% Ta, <8% Ni, <8% Co, <3% Sn, <3% Sb, <3% Be, <3% Hf, <3% Zr, <0.5% Pb, and <3% rare earth metal. Except for a 16% Al, balance Fe alloy, all of the specific examples in Japan '721 include at least 1% Cr and except for a 5% Al, 3% Cr, balance Fe alloy, the remaining examples in Japan '721 include ≧10% Al.

SUMMARY OF THE INVENTION

The invention provides an iron-based alloy useful as an electrical resistance heating element. The alloy has a disordered body centered cubic structure and improved room temperature ductility, resistance to thermal oxidation, cyclic fatigue resistance, electrical resistivity, low and high temperature strength and high temperature sag resistance. In addition, the alloy preferably has low thermal diffusivity. The alloy comprises, in weight %, 4–9.5% Al, 0.5–2.0% Ti, 0.5–2% Mo, 0.1 to 0.8% Zr, 0.01–0.5% C, balance Fe.

According to various preferred aspects of the invention, the alloy can be Cr-free, Mn-free, Si-free, and/or Ni-free. The alloy preferably has an entirely ferritic austenite-free microstructure which is free of insulating enhancing ceramic particles such as SiC, SiN, etc. The alloy can include ≦2% Si, ≦30% Ni, ≦0.5% Y, ≦0.1% B, ≦1% Nb and ≦1% Ta. Preferred alloys include 8.0–9.0% Al, 0.75–1.5% Ti, 0.75–1.5% Mo, 0.15–0.75% Zr and 0.05–0.35% C; 8.0–9.0% Al, 0.75–1.25% Ti, 0.75–1.25% Mo, 0.2 to 0.6%

Zr, 0.03–0.09% C, and 0.01–0.1% Y; 8.0–9.0% Al, 0.75–1.25% Ti, 0.75–1.25% Mo, 0.1–0.3% Zr, 0.01–0.1% C, 0.25–0.75% Nb, 0.25–0.75% Ta and 0.01–0.1% Y; 8.0–9.0% Al, 0.75–1.25% Ti, 0.75–1.25% Mo, 0.5–0.75% Zr, 0.05–0.15% C and 0.01–0.2% Si; and 8.0–9.0% Al, 0.05–0.15% Si, 0.75–1.25% Ti, 0.75–1.25% Mo, 0.1–0.3% Zr and 0.2–0.4% C.

The alloy can have various properties as follows. For instance, the alloy can comprise an electrical resistance heating element for products such as heaters, toasters, igniters, etc. wherein the alloy has a room temperature resistivity of 80–300 μΩ·cm, preferably 90–200 μΩ·cm. The alloy preferably heats to 900° C. in less than 1 second when a voltage up to 10 volts and up to 6 amps is passed through the alloy. When heated in air to 1000° C. for three hours, the alloy preferably exhibits a weight gain of less than 4%. The alloy can have a resistance of 0.05 to 7 ohms throughout a heating cycle between ambient and 900° C. The alloy preferably exhibits thermal fatigue resistance of over 10,000 cycles without breaking when heated from room temperature to 1000° C. for 0.5 to 5 seconds.

With respect to mechanical properties, the alloy has a high strength to weight ratio (i.e., high specific strength) and should exhibit a room temperature ductility of at least 3%. For instance, the alloy can exhibit a room temperature reduction in area of at least 14%, and a room temperature elongation of at least 15%. The alloy preferably exhibits a room temperature yield strength of at least 50 ksi and a room temperature tensile strength of at least 80 ksi. With respect to high temperature properties, the alloy preferably exhibits a high temperature reduction in area at 800° C. of at least 30%, a high temperature elongation at 800° C. of at least 30%, a high temperature yield strength at 800° C. of at least 7 ksi, and a high temperature tensile strength at 800° C. of at least 10 ksi.

DETAILED DESCRIPTION OF THE PREFERRED EMBODIMENTS

Figure 1A:
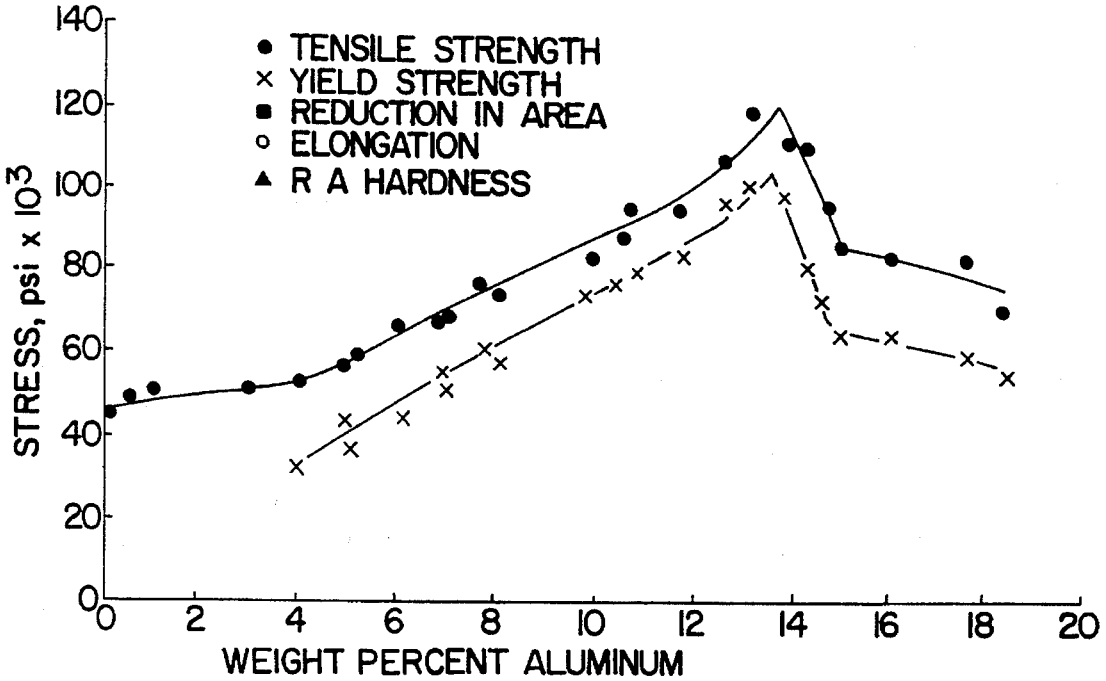
FIG. 1 shows the effect of changes in Al content on room-temperature properties of an aluminum containing iron-base alloy.
Figure 1B:
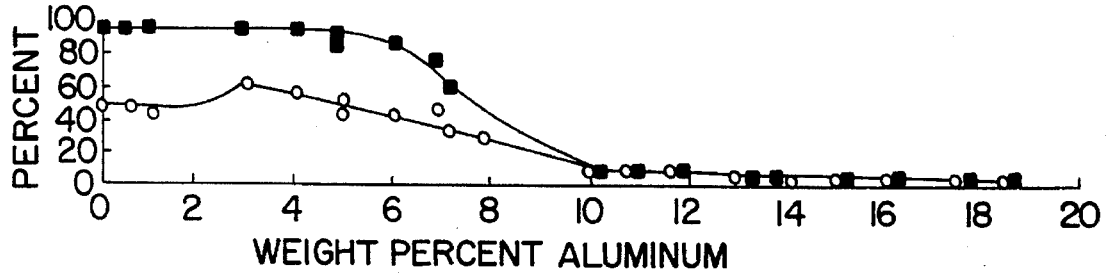
Figure 1C:
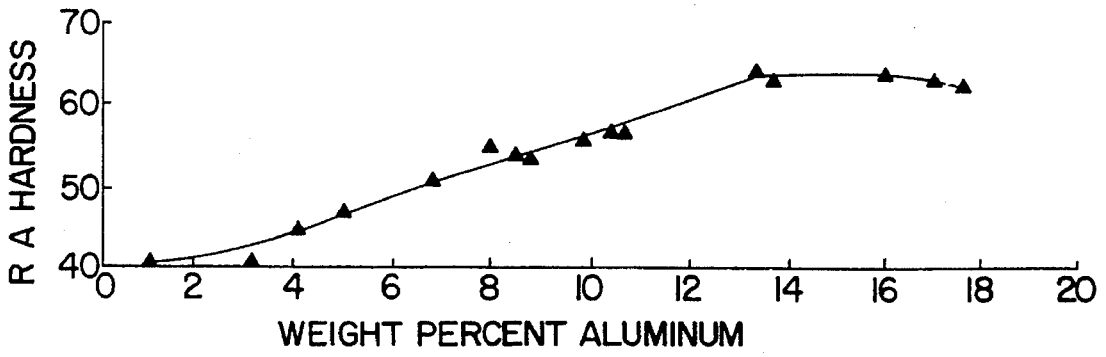
Figure 1D:
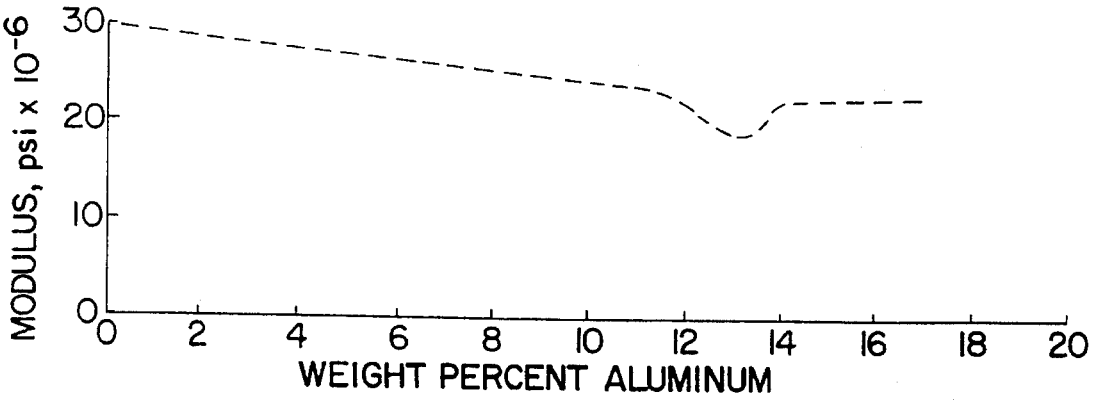

The present invention is directed to improved aluminum containing iron-base alloys which contain 4 to 9.5% by weight (wt %) of aluminum and are defined by solid solutions of aluminum in a disordered body centered cubic crystal lattice structure. The alloys of the present invention preferably are ferritic with an austenite-free microstructure and contain one or more alloy elements selected from molybdenum, titanium, carbon, and a carbide former (such as zirconium, niobium and/or tantalum) which is useable in conjunction with the carbon for forming carbide phases within the solid solution matrix for the purpose of controlling grain size and precipitation strengthening.

In accordance with the present invention it was found that by maintaining the aluminum concentration in the Fe-Al alloys in the narrow range of 4 to 9.5% by weight (nominal) the Fe-Al alloys when wrought could be tailored to provide selected room temperature ductilities at a desirable level by annealing the alloys in a suitable atmosphere at a selected temperature greater than about 700° C. (e.g., 700°–1100° C.) and then air cooling or oil quenching the alloys while retaining yield and ultimate tensile strengths, resistance to oxidation, aqueous corrosion properties which favorably comparable to Fe-Al alloys containing greater than 9.5% by weight aluminum.

With aluminum concentrations lower than about 4 wt % the resulting Fe-Al alloys possess good room-temperature ductility but contain insufficient aluminum for providing acceptable resistance to oxidation. Also, since more iron is present in alloys with less than 4 wt % aluminum, the tensile strength of the alloys drops dramatically due to the presence of additional iron so as to render the alloy unsuitable for many applications desired for the Fe-Al alloys. On the other hand, with aluminum concentrations greater than 9.5 wt % ordering of the crystal phases occurs within the Fe-Al alloy so as to induce embrittlement therein which reduces the room-temperature ductility.

The concentration of the alloying constituents used in forming the Fe-Al alloys of the present invention is expressed herein in nominal weight percent. However, the nominal weight of the aluminum in these alloys essentially corresponds to at least about 97% of the actual weight of the aluminum in the alloys. For example, in the Fe-Al alloy of the preferred composition, as will be described below, a nominal 8.46 wt % provides an actual 8.40 wt % of aluminum, which is about 99% of the nominal concentration.

The Fe-Al alloys of the present invention preferably contain one or more selected alloying elements for improving the strength, room-temperature ductility, oxidation resistance, aqueous corrosion resistance, pitting resistance, thermal fatigue resistance, electrical resistivity, high temperature sag resistance and resistance to weight gain.

When molybdenum is used as one of the alloying constituents it is in an effective range from more than incidental impurities up to about 5.0% with the effective amount being sufficient to promote solid solution hardening of the alloy and resistance to creep of the alloy when exposed to high temperatures. The concentration of the molybdenum can range from 0.25 to 4.25% and is preferably in the range of about 0.75 to 1.50%. Molybdenum additions greater than about 2.0% detract from the room-temperature ductility due to the relatively large extent of solid solution hardening caused by the presence of molybdenum in such concentrations.

Titanium is added in an amount effective to improve creep strength of the alloy and can be present in amounts up to 3%. The concentration of titanium is preferably in the range of about 0.75 to 1.25%.

When carbon and the carbide former are used in the alloy, the carbon is present in an effective amount ranging from more than incidental impurities up to about 0.75% and the carbide former is present in an effective amount ranging from more than incidental impurities up to about 1.0% or more. The effective amount of the carbon and the carbide former are each sufficient to together provide for the formation of sufficient carbides to control grain growth in the alloy during exposure thereof to increasing temperatures. The carbides also provide some precipitation strengthening in the alloys. The concentration of the carbon and the carbide former in the alloy can be such that the carbide addition provides a stoichiometric or near stoichiometric ratio of carbon to carbide former so that essentially no excess carbon will remain in the finished alloy. An excess of a carbide former such as zirconium in the alloy is beneficial in as much as it will help form a spallation-resistant oxide during high temperature thermal cycling in air. Zirconium is more effective than Hf due to the formation of oxide stringers perpendicular to the exposed surface of the alloy which pins the surface oxide whereas Hf forms oxide stringers which are parallel to the surface.

The carbon concentration is preferably in the range of about 0.03% to about 0.3%. The carbide formers include such carbide-forming elements as zirconium, niobium, tantalum and hafnium and combinations thereof. The carbide former is preferably zirconium in a concentration sufficient for forming carbides with the carbon present within the alloy with this amount being in the range of about 0.02% to 0.6%, The concentrations for niobium, tantalum and hafnium when used as carbide formers essentially correspond to those of the zirconium.

In addition to the aforementioned alloy elements the use of an effective amount such as about 0.1% yttrium in the alloy composition is beneficial since it has been found that yttrium improves oxidation resistance of alloy to a level greater than that achievable in previously known iron aluminum alloy systems.

Additional elements which can be added to the alloys according to the invention include Si, Ni and B. For instance, small amounts of Si up to 2.0% can improve low and high temperature strength but room temperature and high temperature ductility of the alloy is adversely affected with additions of Si above 0.25 wt %. The addition of up to 30 wt % Ni can improve strength of the alloy via second phase strengthening but Ni adds to the cost of the alloy and can reduce room and high temperature ductility thus leading to fabrication difficulties particularly at high temperatures. Small amounts of B can improve ductility of the alloy and B can be used in combination with Ti and/or Zr to provide titanium and/or zirconium boride precipitates for grain refinement. The effects to Al, Si and Ti are shown in FIGS. 1–7.

FIG. 1 shows the effect of changes in Al content on room temperature properties of an aluminum containing iron-base alloy. In particular, FIG. 1 shows tensile strength, yield strength, reduction in area, elongation and Rockwell A hardness values for iron-base alloys containing up to 20 wt % Al.

Figure 2A:
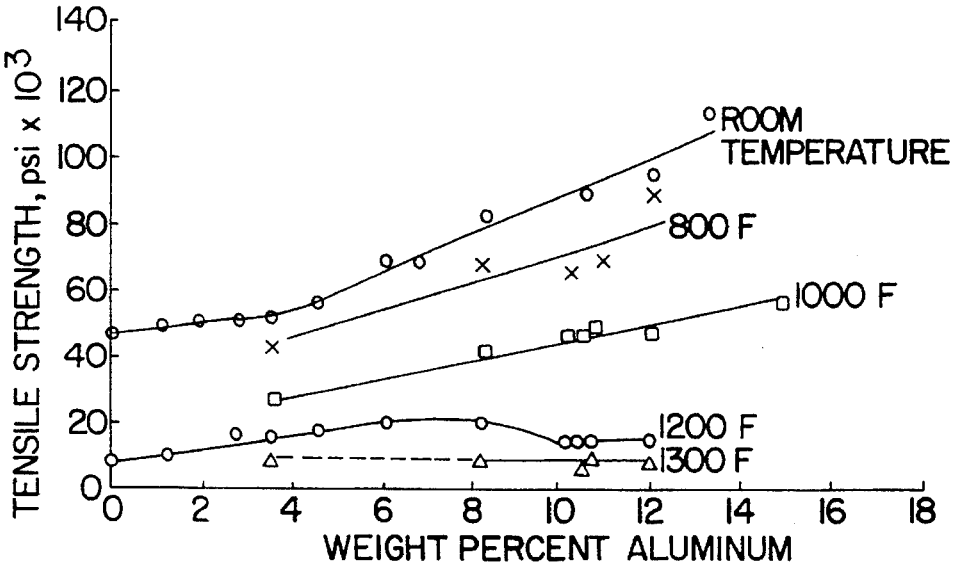
FIG. 2 shows the effect of changes in Al content on room temperature and high-temperature properties of an aluminum containing iron-base alloy.
Figure 2B:
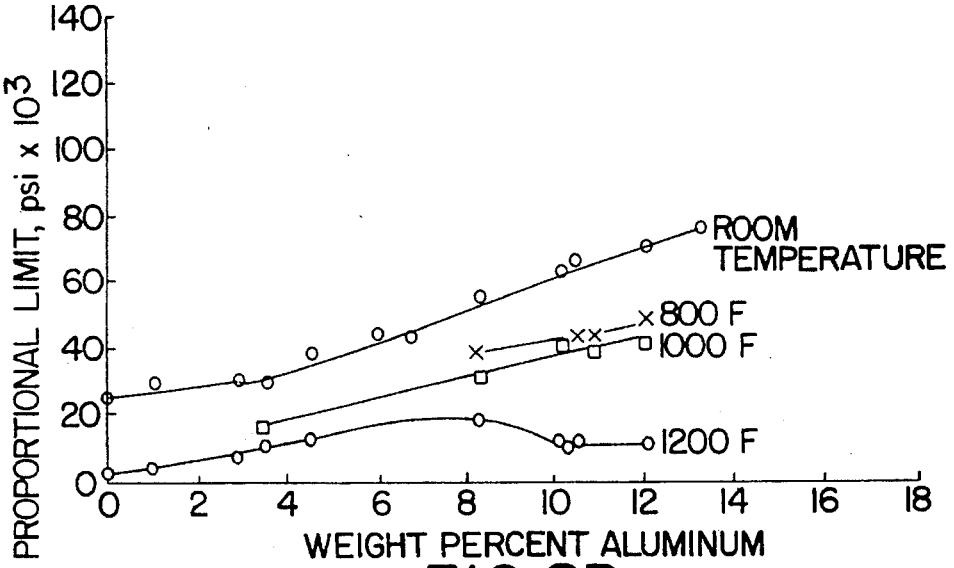

FIG. 2 shows the effect of changes in Al content on high-temperature properties of an aluminum containing iron-base alloy. In particular, FIG. 2 shows tensile strength and proportional limit values at room temperature, 800° F., 1000° F., 1200° F. and 1350° F. for iron-base alloys containing up to 18 wt % Al.

Figure 3A:
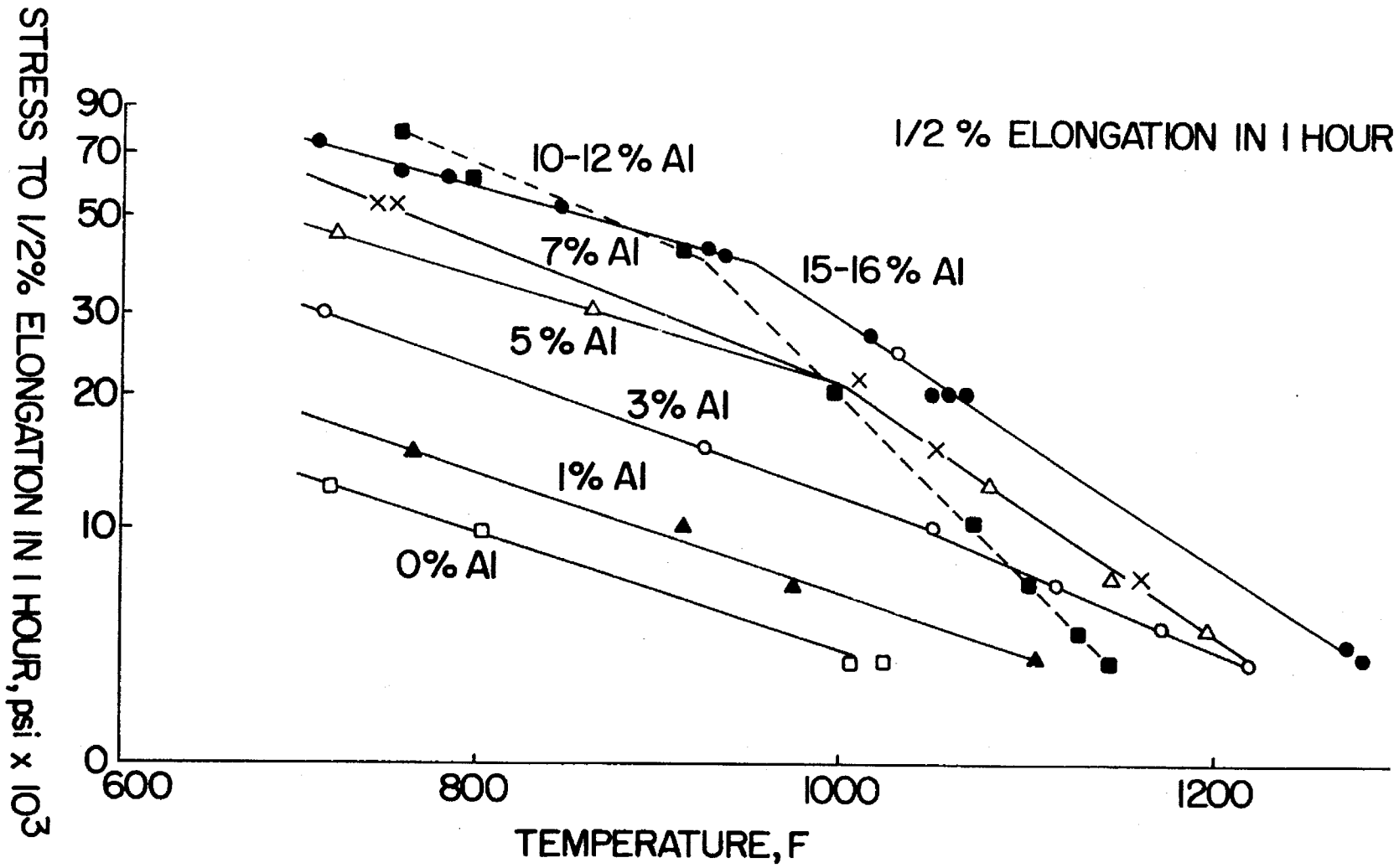
FIG. 3 shows the effect of changes in Al content on high temperature stress to elongation of an aluminum containing iron-base alloy.
Figure 3B:
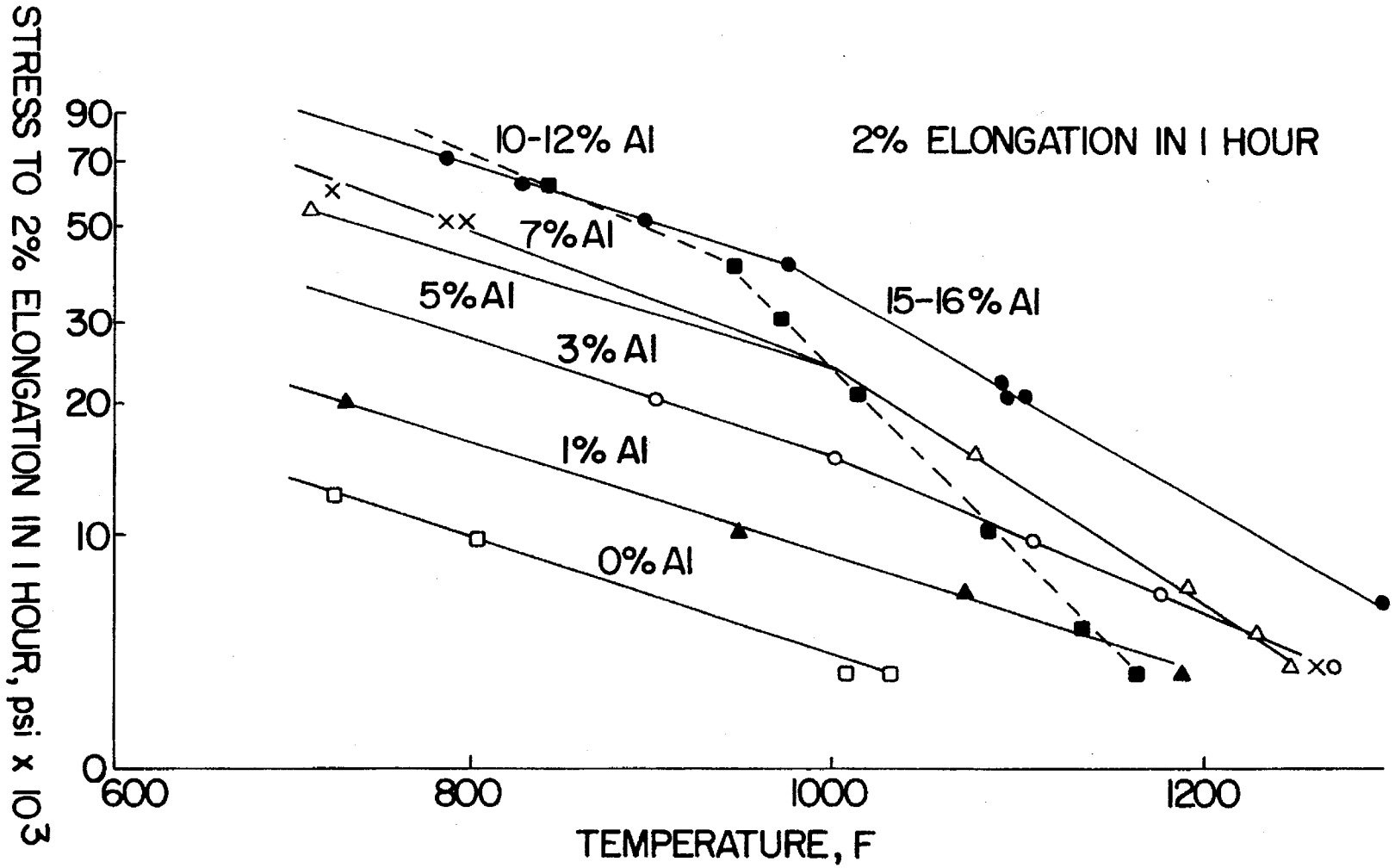

FIG. 3 shows the effect of changes in Al content on high temperature stress to elongation of an aluminum containing iron-base alloy. In particular, FIG. 3 shows stress to ½% elongation and stress to 2% elongation in 1 hour for iron-base alloys containing up to 15–16 wt % Al.

Figure 4A:
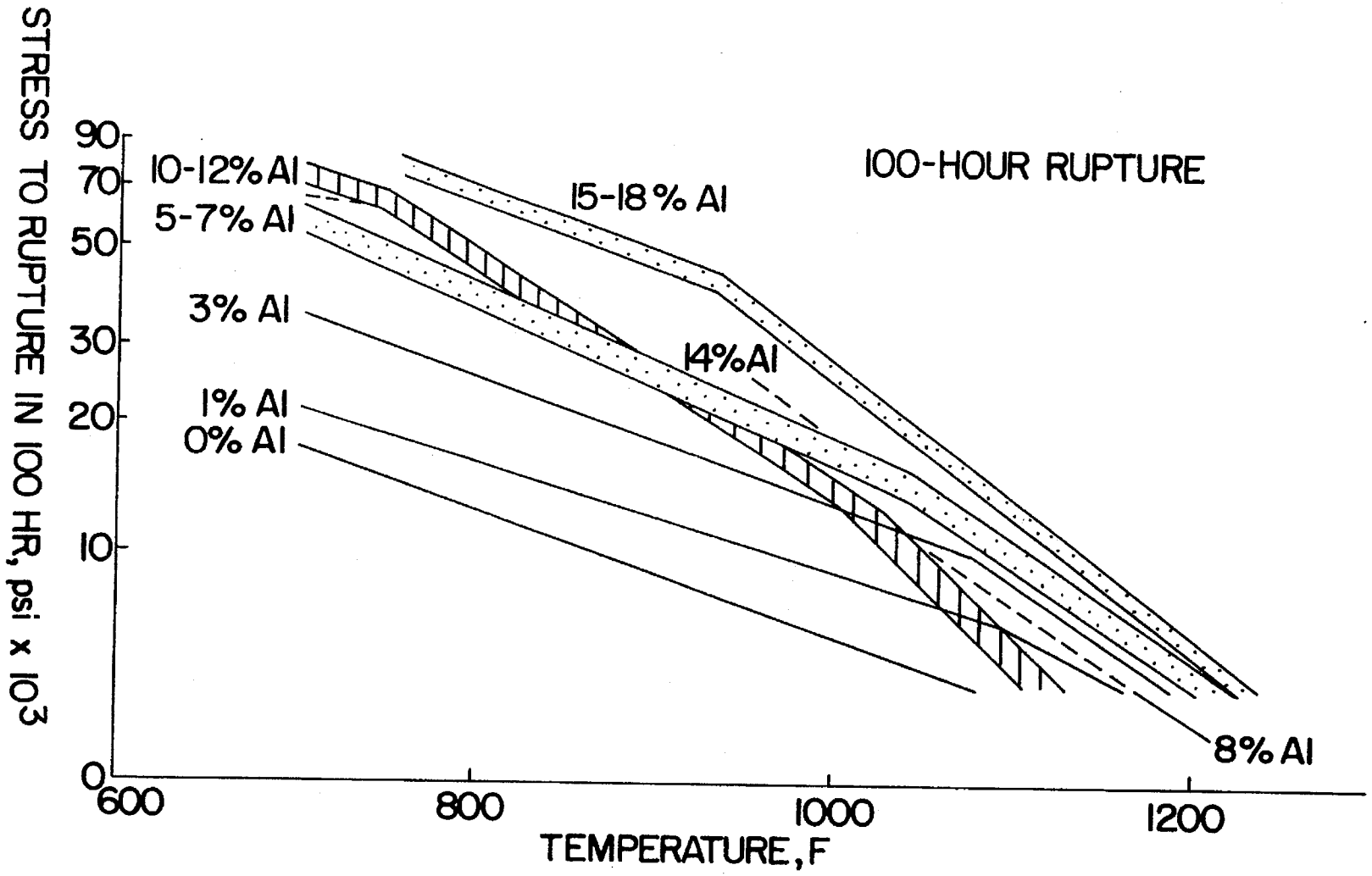
FIG. 4 shows the effect of changes in Al content on stress to rupture (creep) properties of an aluminum containing iron-base alloy.
Figure 4B:
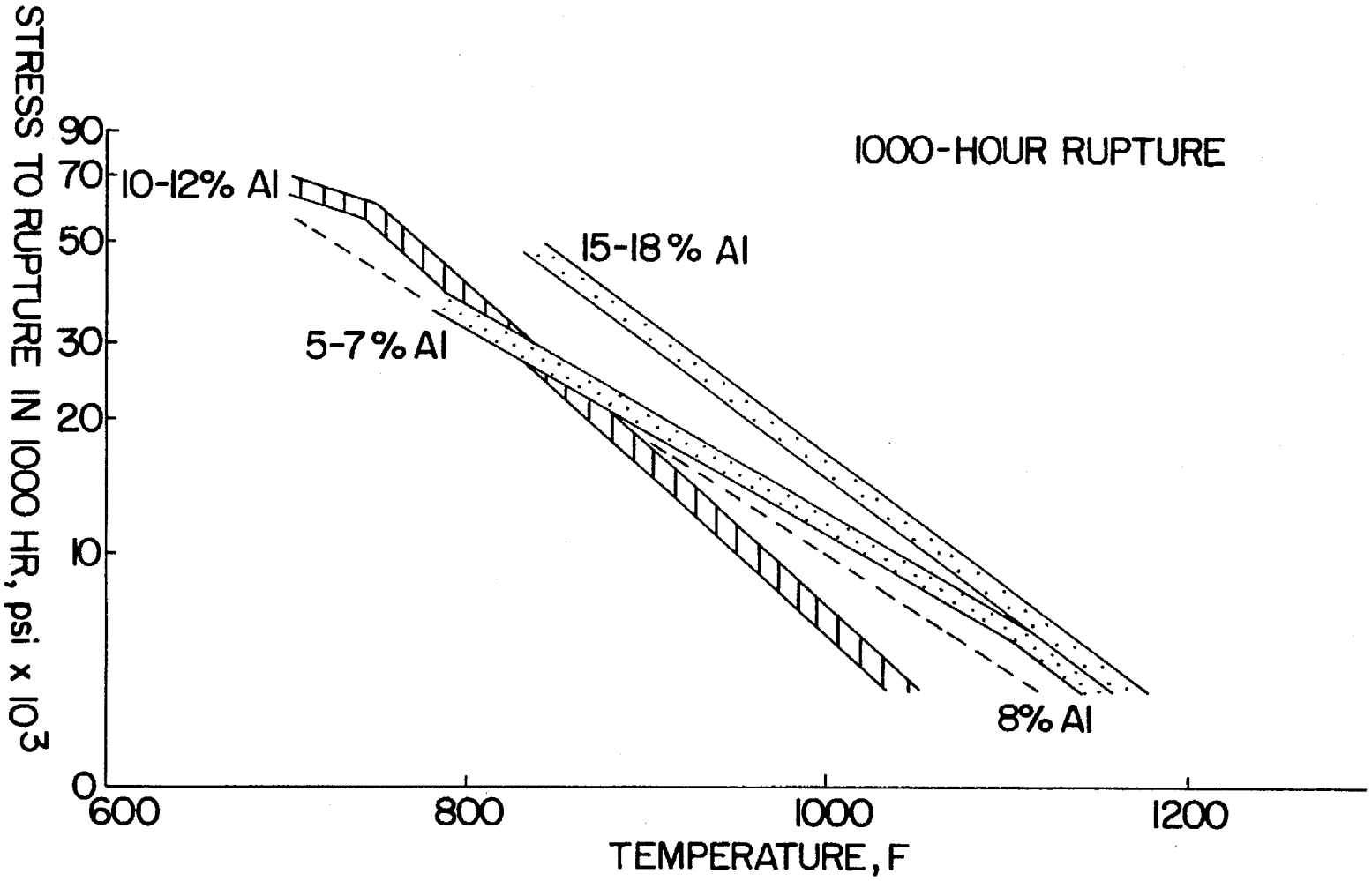

FIG. 4 shows the effect of changes in Al content on creep properties of an aluminum containing iron-base alloy. In particular, FIG. 4 shows stress to rupture in 100 hr. and 1000 hr. for iron-base alloys containing up to 15–18 wt % Al.

Figure 5A:
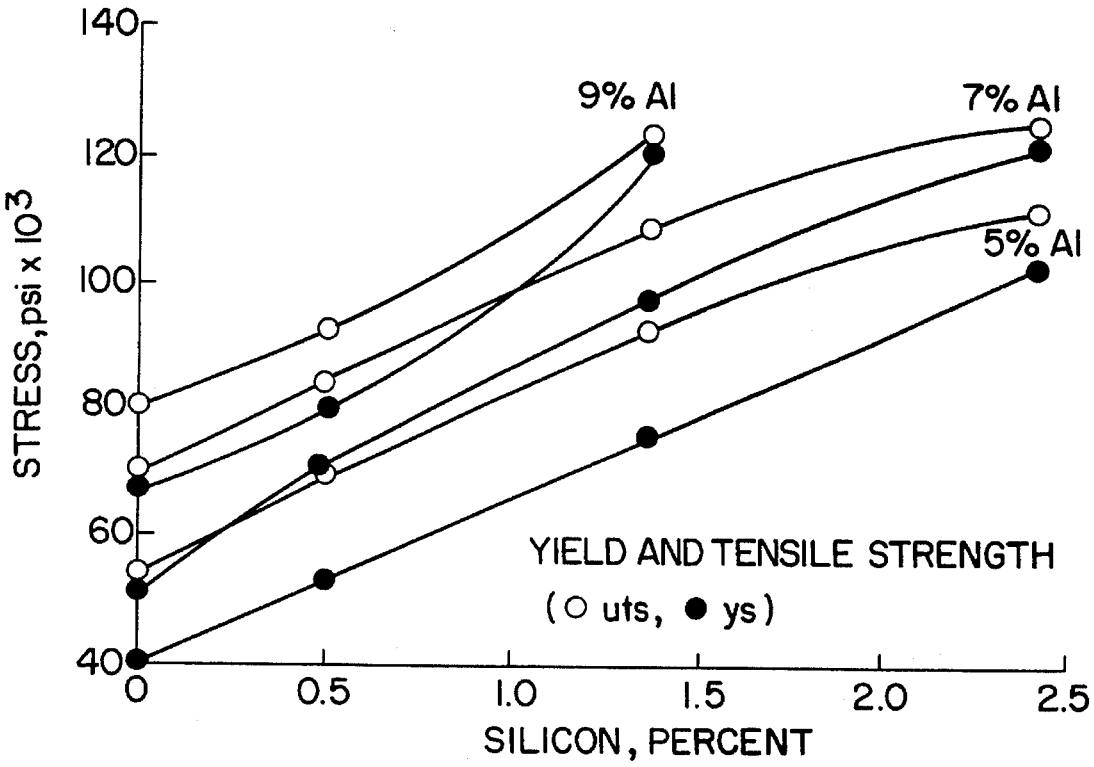
FIG. 5 shows the effect of changes in Si content on room-temperature tensile properties of an Al and Si containing iron-base alloy.
Figure 5B:
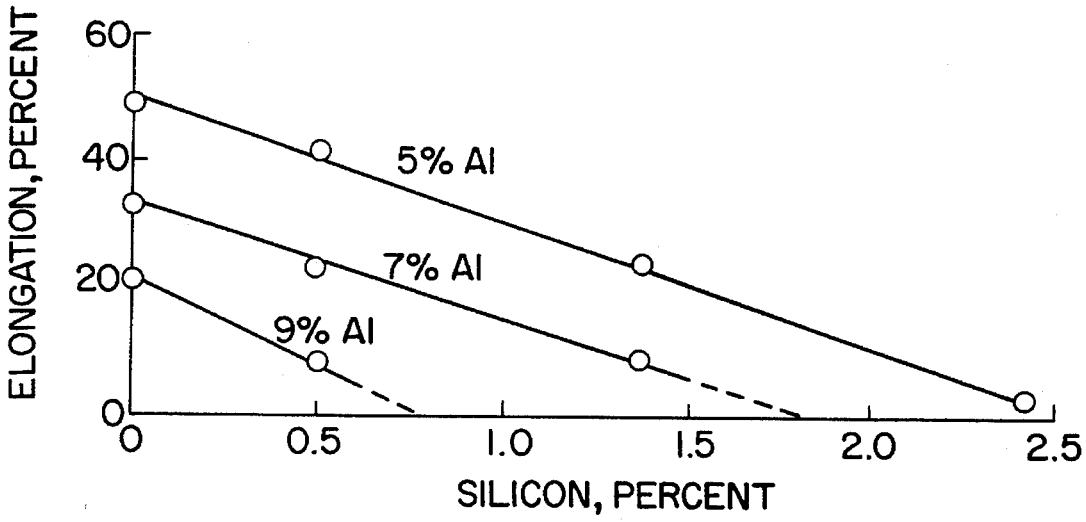

FIG. 5 shows the effect of changes in Si content on room temperature tensile properties of an Al and Si containing iron-base alloy. In particular, FIG. 5 shows yield strength, tensile strength and elongation values for iron-base alloys containing 5.7 or 9 wt % Al and up to 2.5 wt % Si.

Figure 6A:
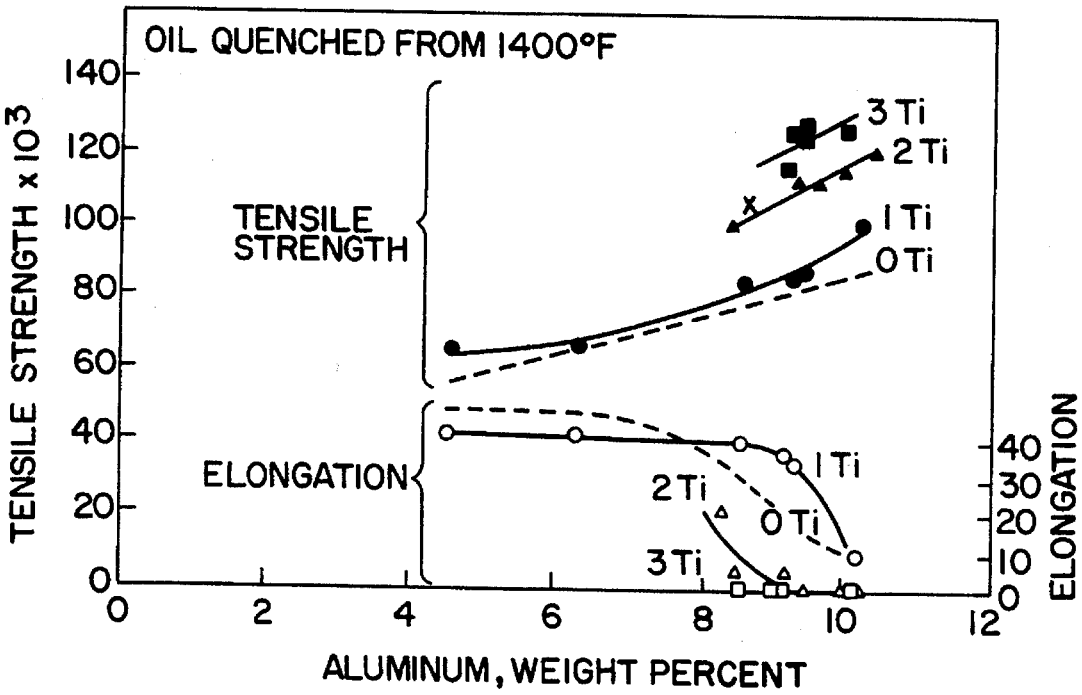
FIG. 6 shows the effect of changes in Ti content on room-temperature properties of an Al and Ti containing iron-base alloy.
Figure 6B:
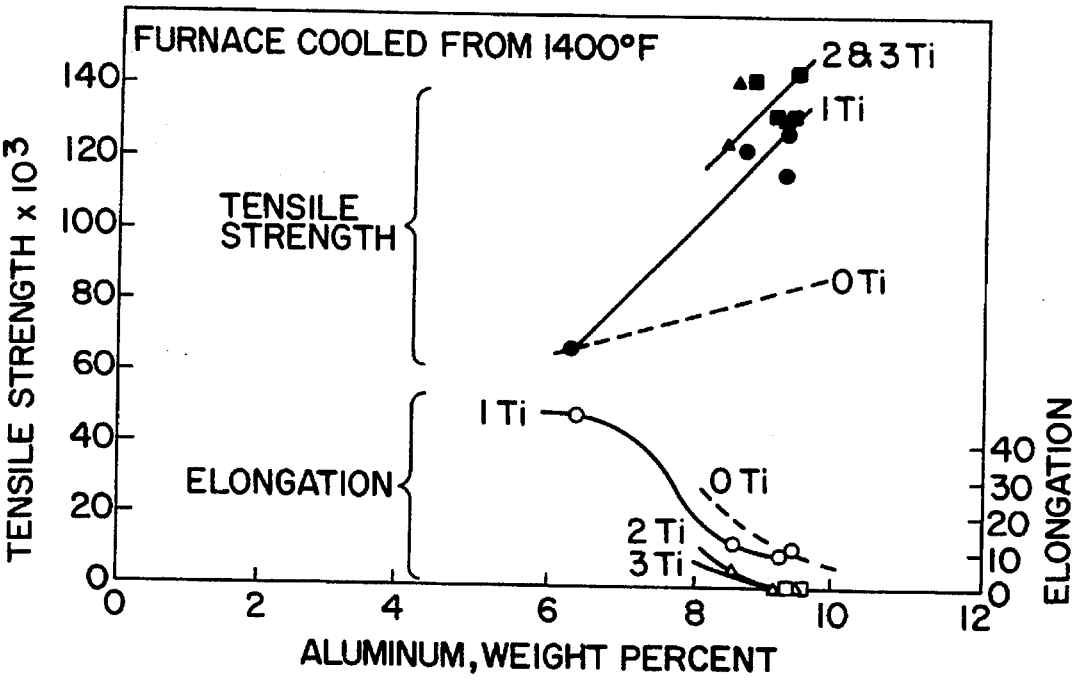

FIG. 6 shows the effect of changes in Ti content on room temperature properties of an Al and Ti containing iron-base alloy. In particular, FIG. 6 shows tensile strength and elongation values for iron-base alloys containing up to 12 wt % Al and up to 3 wt % Ti.

Figure 7:
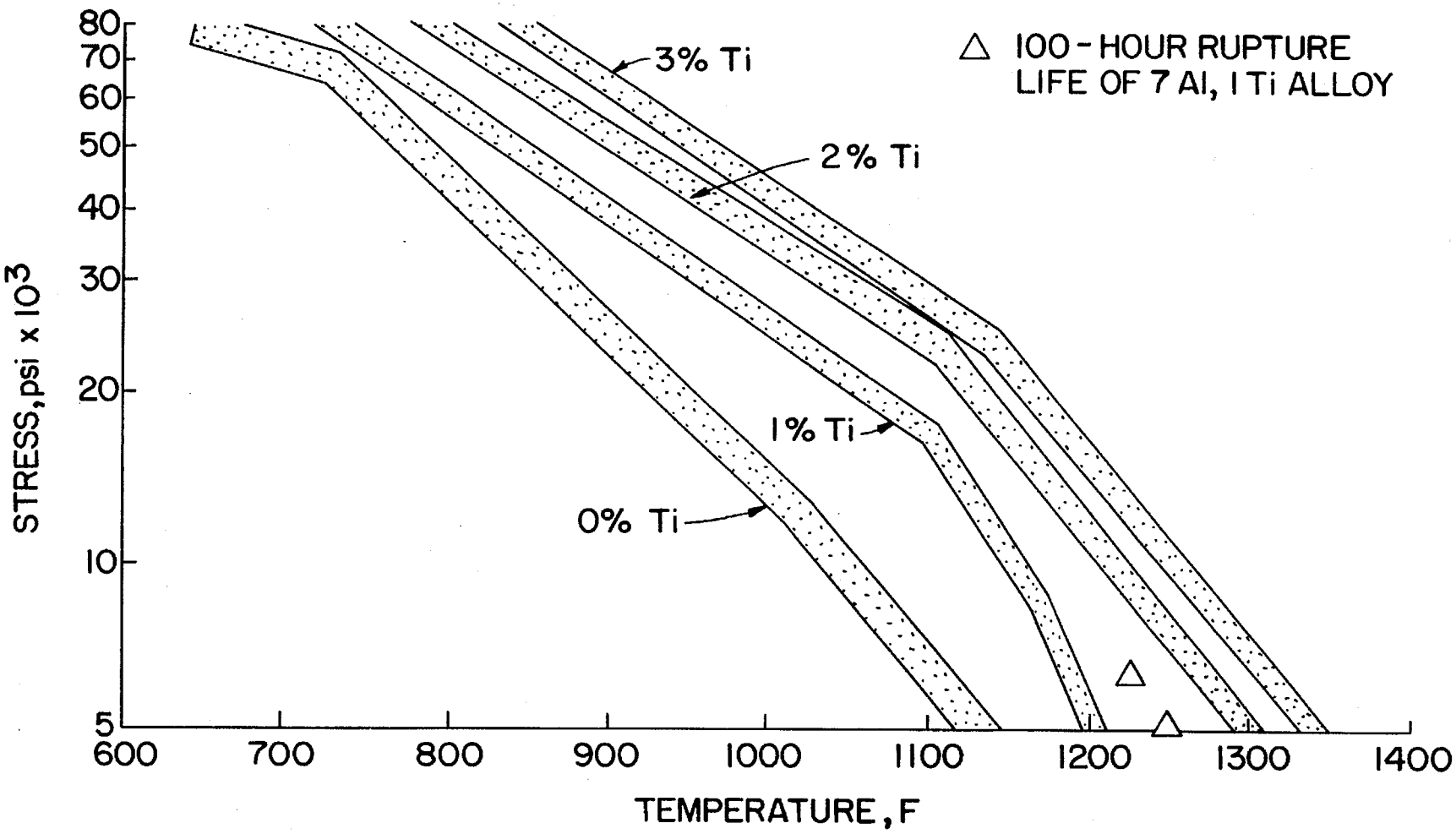
FIG. 7 shows the effect of changes in Ti content on creep rupture properties of a Ti containing iron-base alloy.

FIG. 7 shows the effect of changes in Ti content on creep rupture properties of a Ti containing iron-base alloy. In particular, FIG. 7 shows stress to rupture values for iron-base alloys containing up to 3 wt % Ti at temperatures of 700° to 1350° F.

The Fe-Al alloys of the present invention are preferably formed by the are melting, air induction melting, or vacuum induction melting of powdered and/or solid pieces of the selected alloy constituents at a temperature of about 1600° C. in a suitable crucible formed of $ZrO_2$ or the like. The molten alloy is preferably cast into a mold of graphite or the like in the configuration of a desired product or for forming a heat of the alloy used for the formation of an alloy article by working the alloy.

The melt of the alloy to be worked is cut, if needed, into an appropriate size and then reduced in thickness by forging at a temperature in the range of about 900° to 1100° C., hot rolling at a temperature in the range of about 750° to 850° C., warm rolling at a temperature in the range of about 600° to 700° C., and/or cold rolling at room temperature. Each pass through the cold rolls can provide a 20 to 30% reduction in thickness and is followed by heat treating the alloy in air, inert gas or vacuum at a temperature in the range of about 700° to 1,050° C., preferably about 800° C. for one hour.

Wrought alloy specimens set forth in the following tables were prepared by arc melting the alloy constituents to form heats of the various alloys. These heats were cut into 0.5 inch thick pieces which were forged at 1000° C. to reduce the thickness of the alloy specimens to 0.25 inch (50% reduction), then hot rolled at 800° C. to further reduce the thickness of the alloy specimens to 0.1 inch (60% reduction), and then warm rolled at 650° C. to provide a final thickness of 0.030 inch (70% reduction) for the alloy specimens described and tested herein. For tensile tests, the specimens were punched from 0.030 inch sheet with a ½ inch gauge length of the specimen aligned with the rolling direction of the sheet.

In order to compare compositions of alloys formed in accordance with the present invention with one another and other Fe-Al alloys, alloy compositions according to the invention and for comparison purposes are set forth in Table 1. Table 2 sets forth strength and ductility properties at low and high temperatures for selected alloy compositions in Table 1.

Sag resistance data for various alloys is set forth in Table 3. The sag tests were carried out using strips of the various alloys supported at one end or supported at both ends. The amount of sag was measured after heating the strips in an air atmosphere at 900° C. for the times indicated.

Creep data for various alloys is set forth in Table 4. The creep tests were carried out using a tensile test to determine stress at which samples ruptured at test temperature in 10 h, 100 h and 1000 h.

TABLE 1

| | Composition In Weight % | | | | | | | | | | | | | |
|---|---|---|---|---|---|---|---|---|---|---|---|---|---|---|
| Alloy No. | Fe | Al | Si | Ti | Mo | Zr | C | Ni | Y | B | Nb | Ta | Cr | Ce |
| 1 | 91.5 | 8.5 | | | | | | | | | | | | |
| 2 | 91.5 | 6.5 | 2.0 | | | | | | | | | | | |
| 3 | 90.5 | 8.5 | | 1.0 | | | | | | | | | | |
| 4 | 90.27 | 8.5 | | 1.0 | | 0.2 | 0.03 | | | | | | | |
| 5 | 90.17 | 8.5 | 0.1 | 1.0 | | 0.2 | 0.03 | | | | | | | |
| 6 | 89.27 | 8.5 | | 1.0 | 1.0 | 0.2 | 0.03 | | | | | | | |
| 7 | 89.17 | 8.5 | 0.1 | 1.0 | 1.0 | 0.2 | 0.03 | | | | | | | |
| 8 | 93 | 6.5 | 0.5 | | | | | | | | | | | |
| 9 | 94.5 | 5.0 | 0.5 | | | | | | | | | | | |
| 10 | 92.5 | 6.5 | 1.0 | | | | | | | | | | | |
| 11 | 75.0 | 5.0 | | | | | | 20.0 | | | | | | |
| 12 | 71.5 | 8.5 | | | | | | 20.0 | | | | | | |
| 13 | 72.25 | 5.0 | 0.5 | 1.0 | 1.0 | 0.2 | 0.03 | 20.0 | 0.02 | | | | | |
| 14 | 76.19 | 6.0 | 0.5 | 1.0 | 1.0 | 0.2 | 0.03 | 15.0 | 0.08 | | | | | |
| 15 | 81.19 | 6.0 | 0.5 | 1.0 | 1.0 | 0.2 | 0.03 | 10.0 | 0.08 | | | | | |
| 16 | 86.23 | 8.5 | | 1.0 | 4.0 | 0.2 | 0.03 | | 0.04 | | | | | |
| 17 | 88.77 | 8.5 | | 1.0 | 1.0 | 0.6 | 0.09 | | 0.04 | | | | | |
| 18 | 85.77 | 8.5 | | 1.0 | 1.0 | 0.6 | 0.09 | 3.0 | 0.04 | | | | | |
| 19 | 83.77 | 8.5 | | 1.0 | 1.0 | 0.6 | 0.09 | 5.0 | 0.04 | | | | | |
| 20 | 88.13 | 8.5 | | 1.0 | 1.0 | 0.2 | 0.03 | | 0.04 | | 0.5 | 0.5 | | |
| 21 | 61.48 | 8.5 | | | | | | 30.0 | | 0.02 | | | | |
| 22 | 88.90 | 8.5 | 0.1 | 1.0 | 1.0 | 0.2 | 0.3 | | | | | | | |
| 23 | 87.60 | 8.5 | 0.1 | 2.0 | 1.0 | 0.2 | 0.6 | | | | | | | |
| 24 | bal | 8.19 | | | | | | | | | | | 2.13 | |
| 25 | bal | 8.30 | | | | | | | | | | | 4.60 | |
| 26 | bal | 8.28 | | | | | | | | | | | 6.93 | |
| 27 | bal | 8.22 | | | | | | | | | | | 9.57 | |
| 28 | bal | 7.64 | | | | | | | | | | | 7.46 | |
| 29 | bal | 7.47 | 0.32 | | | | | | | | | | 7.53 | |
| 30 | 84.75 | 8.0 | | | 6.0 | 0.8 | 0.1 | | | | 0.25 | | | 0.1 |
| 31 | 85.10 | 8.0 | | | 6.0 | 0.8 | 0.1 | | | | | | | |
| 32 | 86.00 | 8.0 | | | 6.0 | | | | | | | | | |

TABLE 2

| Alloy No. | Heat Treat-ment | Test Temp. (°C.) | Yield Strength (ksi) | Tensile Strength (ksi) | Elon-gation (%) | Reduc-tion In Area (%) |
|---|---|---|---|---|---|---|
| 1 | A | 23 | 60.60 | 73.79 | 25.50 | 41.46 |
| 1 | B | 23 | 55.19 | 68.53 | 23.56 | 31.39 |
| 1 | A | 800 | 3.19 | 3.99 | 108.76 | 72.44 |
| 1 | B | 800 | 1.94 | 1.94 | 122.20 | 57.98 |
| 2 | A | 23 | 94.16 | 94.16 | 0.90 | 1.55 |
| 2 | A | 800 | 6.40 | 7.33 | 107.56 | 71.87 |
| 3 | A | 23 | 69.63 | 86.70 | 22.64 | 28.02 |
| 3 | A | 800 | 7.19 | 7.25 | 94.00 | 74.89 |
| 4 | A | 23 | 70.15 | 89.85 | 29.88 | 41.97 |
| 4 | B | 23 | 65.21 | 85.01 | 30.94 | 35.68 |
| 4 | A | 800 | 5.22 | 7.49 | 144.70 | 81.05 |
| 4 | B | 800 | 5.35 | 5.40 | 105.96 | 75.42 |
| 5 | A | 23 | 73.62 | 92.68 | 27.32 | 40.83 |
| 5 | B | 800 | 9.20 | 9.86 | 198.96 | 89.19 |
| 6 | A | 23 | 74.50 | 93.80 | 30.36 | 40.81 |
| 6 | A | 800 | 9.97 | 11.54 | 153.00 | 85.56 |
| 7 | A | 23 | 79.29 | 99.11 | 19.60 | 21.07 |
| 7 | B | 23 | 75.10 | 97.09 | 13.20 | 16.00 |
| 7 | A | 800 | 10.36 | 10.36 | 193.30 | 84.46 |
| 7 | B | 800 | 7.60 | 9.28 | 167.00 | 82.53 |
| 8 | A | 23 | 51.10 | 66.53 | 35.80 | 27.96 |
| 8 | A | 800 | 4.61 | 5.14 | 155.80 | 55.47 |
| 9 | A | 23 | 37.77 | 59.67 | 34.20 | 18.88 |
| 9 | A | 800 | 5.56 | 6.09 | 113.50 | 48.82 |
| 10 | A | 23 | 64.51 | 74.46 | 14.90 | 1.45 |
| 10 | A | 800 | 5.99 | 6.24 | 107.86 | 71.00 |
| 13 | A | 23 | 151.90 | 185.88 | 10.08 | 15.98 |
| 13 | C | 23 | 163.27 | 183.96 | 7.14 | 21.54 |

TABLE 2-continued

| Alloy No. | Heat Treat-ment | Test Temp. (°C.) | Yield Strength (ksi) | Tensile Strength (ksi) | Elon-gation (%) | Reduc-tion In Area (%) |
|---|---|---|---|---|---|---|
| 13 | A | 800 | 9.49 | 17.55 | 210.90 | 89.01 |
| 13 | C | 800 | 25.61 | 29.90 | 62.00 | 57.66 |
| 16 | A | 23 | 86.48 | 107.44 | 6.46 | 7.09 |
| 16 | A | 800 | 14.50 | 14.89 | 94.64 | 76.94 |
| 17 | A | 23 | 76.66 | 96.44 | 27.40 | 45.67 |
| 17 | B | 23 | 69.68 | 91.10 | 29.04 | 39.71 |
| 17 | A | 800 | 9.37 | 11.68 | 111.10 | 85.69 |
| 17 | B | 800 | 12.05 | 14.17 | 108.64 | 75.67 |
| 20 | A | 23 | 88.63 | 107.02 | 17.94 | 28.60 |
| 20 | B | 23 | 77.79 | 99.70 | 24.06 | 37.20 |
| 20 | A | 800 | 7.22 | 11.10 | 127.32 | 80.37 |
| 20 | B | 800 | 13.58 | 14.14 | 183.40 | 88.76 |
| 21 | D | 23 | 207.29 | 229.76 | 4.70 | 14.25 |
| 21 | C | 23 | 85.61 | 159.98 | 38.00 | 32.65 |
| 21 | D | 800 | 45.03 | 55.56 | 37.40 | 35.08 |
| 21 | C | 800 | 48.58 | 57.81 | 8.40 | 8.34 |
| 22 | C | 23 | 67.80 | 91.13 | 26.00 | 42.30 |
| 22 | C | 800 | 10.93 | 11.38 | 108.96 | 79.98 |
| 24 | E | 23 | 71.30 | 84.30 | 23 | 33 |
| 24 | F | 23 | 69.30 | 84.60 | 22 | 40 |
| 25 | E | 23 | 73.30 | 85.20 | 34 | 68 |
| 25 | F | 23 | 71.80 | 86.90 | 27 | , 60 |
| 26 | E | 23 | 61.20 | 83.25 | 15 | 15 |
| 26 | F | 23 | 61.20 | 84.20 | 21 | 27 |
| 27 | E | 23 | 59.60 | 86.90 | 13 | 15 |
| 27 | F | 23 | — | 88.80 | 18 | 19 |
| 28 | E | 23 | 60.40 | 77.70 | 35 | 74 |
| 28 | E | 23 | 59.60 | 79.80 | 26 | 58 |

TABLE 2-continued

| Alloy No. | Heat Treat-ment | Test Temp. (°C.) | Yield Strength (ksi) | Tensile Strength (ksi) | Elon-gation (%) | Reduc-tion In Area (%) |
|---|---|---|---|---|---|---|
| 29 | F | 23 | 62.20 | 76.60 | 17 | 17 |
| 29 | F | 23 | 61.70 | 86.80 | 12 | 12 |
| 30 | | 23 | 97.60 | 116.60 | 4 | 5 |
| 30 | | 650 | 26.90 | 28.00 | 38 | 86 |
| 31 | | 23 | 79.40 | 104.30 | 7 | 7 |
| 31 | | 650 | 38.50 | 47.00 | 27 | 80 |
| 32 | | 23 | 76.80 | 94.80 | 7 | 5 |
| 32 | | 650 | 29.90 | 32.70 | 35 | 86 |

Heat Treatments of Samples
A = 800° C./1 hr./Air Cool
B = 1050° C./2 hr./Air Cool
C = 1050° C./2 hr. in Vacuum
D = As rolled
E = 815° C./1 hr./oil Quench
F = 815° C./1 hr./furnace cool
Alloys 1–22 tested with 0.2 inch/min. strain rate

TABLE 3

| Ends of Sample Supported | Sample Thickness (mil) | Length of Heating (h) | Amount of Sag (inch) Alloy 17 | Alloy 20 | Alloy 22 |
|---|---|---|---|---|---|
| One[a] | 30 | 16 | ⅛ | — | — |
| One[b] | 30 | 21 | — | ⅜ | ⅛ |
| Both | 30 | 185 | — | 0 | 0 |
| Both | 10 | 68 | — | — | ⅛ |

Additional Conditions
[a]wire weight hung on free end to make samples have same weight
[b]foils of same length and width placed on samples to make samples have same weight

TABLE 4

| Sample | Test Temperature °F. | °C. | Creep Rupture Strength (ksi) 10 h | 100 h | 1000 h |
|---|---|---|---|---|---|
| 1 | 1400 | 760 | 2.90 | 2.05 | 1.40 |
| | 1500 | 816 | 1.95 | 1.35 | 0.95 |
| | 1600 | 871 | 1.20 | 0.90 | — |
| | 1700 | 925 | 0.90 | — | — |
| 4 | 1400 | 760 | 3.50 | 2.50 | 1.80 |
| | 1500 | 816 | 2.40 | 1.80 | 1.20 |
| | 1600 | 871 | 1.65 | 1.15 | — |
| | 1700 | 925 | 1.15 | — | — |
| 5 | 1400 | 760 | 3.60 | 2.50 | 1.85 |
| | 1500 | 816 | 2.40 | 1.80 | 1.20 |
| | 1600 | 871 | 1.65 | 1.15 | — |
| | 1700 | 925 | 1.15 | — | — |
| 6 | 1400 | 760 | 3.50 | 2.60 | 1.95 |
| | 1500 | 816 | 2.50 | 1.90 | 1.40 |
| | 1600 | 871 | 1.80 | 1.30 | — |
| | 1700 | 925 | 1.30 | — | — |
| 7 | 1400 | 760 | 3.90 | 2.90 | 2.15 |
| | 1500 | 816 | 2.80 | 2.00 | 1.65 |
| | 1600 | 871 | 2.00 | 1.50 | — |
| | 1700 | 925 | 1.50 | — | — |
| 17 | 1400 | 760 | 3.95 | 3.0 | 2.3 |
| | 1500 | 816 | 2.95 | 2.20 | 1.75 |
| | 1600 | 871 | 2.05 | 1.65 | 1.25 |
| | 1700 | 925 | 1.65 | 1.20 | — |
| 20 | 1400 | 760 | 4.90 | 3.25 | 2.05 |
| | 1500 | 816 | 3.20 | 2.20 | 1.65 |
| | 1600 | 871 | 2.10 | 1.55 | 1.0 |
| | 1700 | 925 | 1.56 | 0.95 | — |
| 22 | 1400 | 760 | 4.70 | 3.60 | 2.65 |
| | 1500 | 816 | 3.55 | 2.60 | 1.35 |
| | 1600 | 871 | 2.50 | 1.80 | 1.25 |
| | 1700 | 925 | 1.80 | 1.20 | 1.0 |

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An iron-based alloy useful as an electrical resistance heating element and having a disordered body centered cubic structure, the alloy having improved room temperature ductility, resistance to cyclic oxidation, thermal fatigue resistance, electrical resistivity and high temperature sag resistance, and comprising, in weight %, 4 to 9.5% Al, 0.5–2.0% Ti, 0.5–2% Mo, 0.1 to 0.8% Zr, 0.01–0.5% C, balance Fe.

2. The iron-based alloy of claim 1, wherein the alloy is Ni-free.

3. The iron-based alloy of claim 1, wherein the alloy has a microstructure which is austenite-free.

4. The iron-based alloy of claim 1, wherein the alloy has an entirely ferritic microstructure.

5. The iron-based alloy of claim 1, wherein the alloy is free of ceramic particles.

6. The iron-based alloy of claim 1, wherein the alloy includes ≦2% Si, ≦30% Ni, ≦0.5% Y, ≦0.1% B, ≦1% Nb and ≦1% Ta.

7. The iron-based alloy of claim 1, wherein the alloy consists essentially of 8.0–9.0% Al, 0.75–1.5% Ti, 0.75–1.5% Mo, 0.15–0.75% Zr, 0.05–0.35% C, balance Fe.

8. The iron-based alloy of claim 1, wherein the alloy consists essentially of 8.0–9.0% Al, 0.75–1.25% Ti, 0.75–1.25% Mo, 0.2 to 0.6% Zr, 0.03–0.09% C, 0.01–0.1% Y, balance Fe.

9. The iron-based alloy of claim 1, wherein the alloy consists essentially of 8.0–9.0% Al, 0.75–1.25% Ti, 0.75–1.25% Mo, 0.1–0.3% Zr, 0.01–0.1% C, 0.25–0.75% Nb, 0.25–0.75% Ta and 0.01–0.1% Y, balance Fe.

10. The iron-based alloy of claim 1, wherein the alloy consists essentially of 8.0–9.0% Al, 0.75–1.25% Ti, 0.75–1.25% Mo, 0.5–0.75% Zr, 0.05–0.15% C and 0.01–0.2% Si, balance Fe.

11. The iron-based alloy of claim 1, wherein the alloy consists essentially of 8.0–9.0% Al, 0.05–0.15% Si, 0.75–1.25% Ti, 0.75–1.25% Mo, 0.1–0.3% Zr and 0.2–0.4% C, balance Fe.

12. The iron-based alloy of claim 1, wherein the alloy comprises an electrical resistance heating element having a room temperature resistivity of 80–400 μΩ·cm.

13. The iron-based alloy of claim 1, wherein the alloy exhibits room temperature ductility of at least 3%.

14. The iron-based alloy of claim 1, wherein the alloy heats to 900° C. in less than 1 second when a voltage up to 10 volts and up to 6 amps is passed through the alloy.

15. The iron-based alloy of claim 1, wherein the alloy exhibits a weight gain of less than 4% when heated in air to 1000° C. for three hours.

16. The iron-based alloy of claim 1, wherein the alloy has a resistance of 0.05 to 7 ohms throughout a heating cycle between ambient and 900° C.

17. The iron-based alloy of claim 1, wherein the alloy has a resistivity of 80 to 200 Ω·cm throughout a heating cycle between ambient and 900° C.

18. The iron-based alloy of claim 1, wherein the alloy exhibits a room temperature reduction in area of at least 14%.

19. The iron-based alloy of claim 1, wherein the alloy exhibits a room temperature elongation of at least 15%.

20. The iron-based alloy of claim 1, wherein the alloy exhibits a room temperature yield strength of at least 50 ksi.

21. The iron-based alloy of claim 1, wherein the alloy exhibits a room temperature tensile strength of at least 80 ksi.

22. The iron-based alloy of claim 1, wherein the alloy exhibits a high temperature reduction in area at 800° C. of at least 30%.

23. The iron-based alloy of claim 1, wherein the alloy exhibits a high temperature elongation at 800° C. of at least 30%.

24. The iron-based alloy of claim 1, wherein the alloy exhibits a high temperature yield strength at 800° C. of at least 7 ksi.

25. The iron-based alloy of claim 1, wherein the alloy exhibits a high temperature tensile strength at 800° C. of at least 10 ksi.

26. The iron-based alloy of claim 1, wherein the alloy exhibits thermal fatigue resistance of over 10,000 cycles without breaking when heated from room temperature to 1000° C. for 0.5 to 5 seconds in each of the cycles.

27. The iron-based alloy of claim 1, wherein the alloy is Cr-free.

28. The iron-based alloy of claim 1, wherein the alloy is Mn-free and/or Si-free.

* * * * *